United States Patent [19]

Stähle

[11] Patent Number: 4,540,334

[45] Date of Patent: Sep. 10, 1985

[54] OPEN-TYPE CENTRIFUGAL PUMP WITH SINGLE-BLADE IMPELLER

[76] Inventor: Martin Stähle, I der Gige 392, 8213 Neunkirch, Switzerland

[21] Appl. No.: 556,165

[22] Filed: Nov. 29, 1983

[30] Foreign Application Priority Data

Dec. 22, 1982 [CH] Switzerland ..... 7505/82
Apr. 20, 1983 [CH] Switzerland ..... 2121/83

[51] Int. Cl.[3] ..... F04D 17/06; F04D 7/02

[52] U.S. Cl. ..... 415/72; 415/121 B; 415/215; 416/188

[58] Field of Search ..... 415/71, 213 R, 215, 415/72, 121 B, 213 A, 73, 74; 416/188, 245 B

[56] References Cited

U.S. PATENT DOCUMENTS 2,202,790 5/1940 Forrest ..... 415/213 A
2,845,870 8/1958 Lock ..... 415/72
3,028,140 4/1962 Lage ..... 415/213 R
4,347,035 8/1982 Stahle ..... 415/71

FOREIGN PATENT DOCUMENTS 1528890 1/1970 Fed. Rep. of Germany ..... 415/98

*Primary Examiner*—Robert E. Garrett
*Assistant Examiner*—H. Edward Li

[57] ABSTRACT

The housing wall (23) through which the impeller shaft passes is embodied as a truncated cone. The leading edge (28) of the impeller blade flank (27) on the delivery side of the pump which grazes this housing wall with little clearance (24) extends in a spiral from the impeller blade tip (35) up to a point (31) at which it terminate in the hub; as a result, a relatively large area of the housing wall (23) having a width b decreasing toward the inside and located between the blade flank on the delivery side and the blade flank on the intake side is exposed between the blade outlet tip (35) and this terminal point (31).

22 Claims, 10 Drawing Figures

OPEN-TYPE CENTRIFUGAL PUMP WITH SINGLE-BLADE IMPELLER

FIELD OF THE INVENTION

The present invention relates to a centrifugal pump of the open type, having a single-blade impeller, and intended in particular for pumping viscous media. The discharge end of the blade, with clearance, grazes a housing wall through which the shaft of the impeller passes, and the blade flank on the delivery side of the pump terminates prior to the housing wall in a leading edge which extends between the tip of the end edge of the blade and the hub of the impeller.

BACKGROUND OF THE INVENTION

In known centrifugal pumps of this kind, the housing wall through which the impeller shaft passes is located in a radial plane and is to a great extent covered axially by the blade, because the leading edge referred to above is quite short. As a result, relatively little of the medium being pumped reaches the housing wall, and accordingly it cannot be engaged by the blade flank on the delivery side and pumped into the discharge conduit.

SUMMARY OF THE INVENTION

By contrast, the object of the present invention is to create a centrifugal pump of the general type described above but in which the housing wall and the leading edge cooperate in such a way that satisfactory pumping even of viscous media is attained.

To this end, the centrifugal pump according to the invention is embodied such that the housing wall is a right truncated cone, and the leading edge of the impeller blade flank on the delivery side which grazes the wall of the truncated cone extends over a relatively long distance from the discharge tip of the blade to a point at which it terminates in the impeller hub.

It is thereby provided that a relatively large area of the rearward housing wall is exposed and made available for contact with the flow of material being pumped. As a consequence, viscous media which are difficult to pump by centrifugal action adhere to the exposed area of the stationary housing wall, where the blade flank on the delivery side exerts pressure upon such viscous media and pumps same by positive displacement into the discharge conduit of the pump housing.

If the centrifugal pump according to the invention is used for pumping long-fibered suspended solids, then in accordance with a further provision of the invention the leading edge may be embodied as a sharp shearing edge which cooperates with a counterpart shearing edge of the housing wall.

Thus if the pump has aspirated a piece of fibrous material which has then become wrapped around the blade, it is provided that even at relatively small blade flank angles the fibrous material will slide on the blade flank or, in other words, toward the housing wall as far as the point where the leading edge merges with the hub. This point on the leading edge of the blade rotates directly above the truncated cone of the housing wall, thus guiding the piece of fibrous material via the counterpart edge of the housing wall and producing a shearing action to shred the fibrous material.

It should be noted that for the centrifugal pumps of the invention to be entirely successful, the angles of critical importance here—namely the cone angle of the housing wall, the flank angle of the blade and the circumferential angle of the leading edge of the blade, the counterpart edge angle on the housing and the shearing edge angle on the blade—may vary within relatively wide limits. The cone angle of the housing wall and the flank angle of the blade may be between 5° and 70°, and the leading edge circumferential angle may be between 20° and 360° or more. The counterpart shearing edge angle and the shearing edge angle may each be between 5° and 90°, except that both cannot be 90° because when added together they must not amount to as much as 180°.

The invention will be described in further detail below, referring to the drawings, which show exemplary embodiments.

DESCRIPTION OF THE PREFERRED EMBODIMENTS

Figure 2:
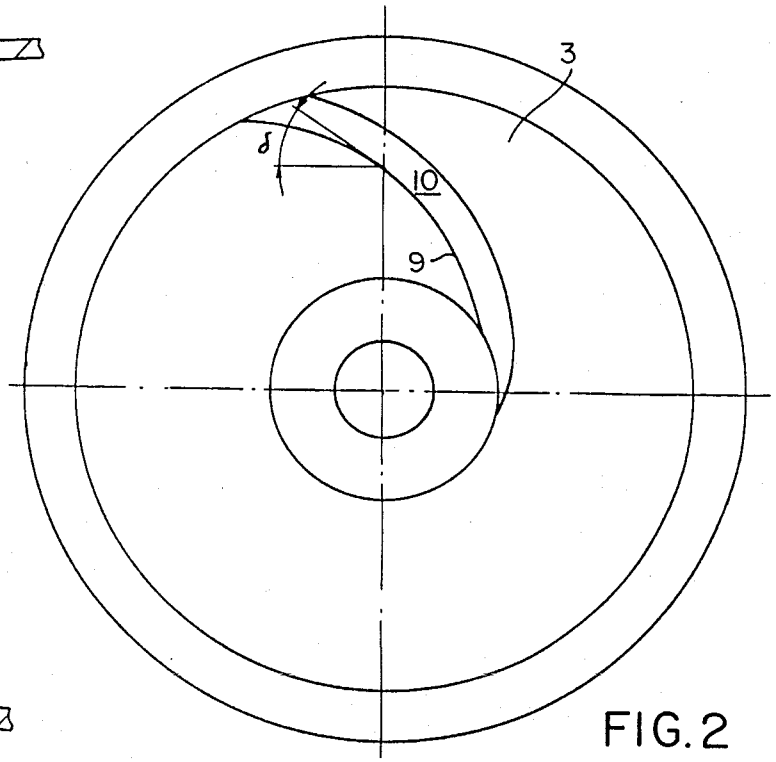
FIG. 2 is a plan view of the truncated-cone housing wall of FIG. 1.
Figure 1:
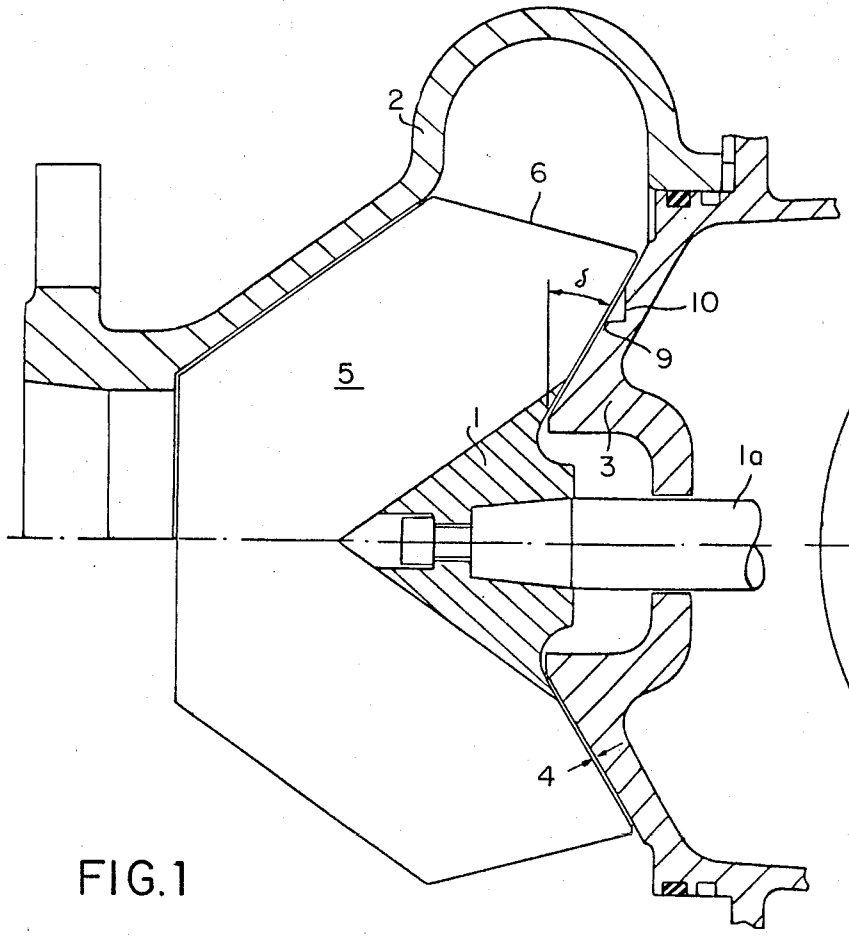
FIG. 1, in an axial section, shows the pump housing of a first exemplary embodiment of the invention with an impeller shown in schematic form.

The single-blade impeller of FIG. 1 has a conical hub 1, the shaft 1*a* of which is supported in a manner not shown in detail in the housing 2 and passes through the housing wall 3 on the delivery side of the pump. The housing wall 3 forms a right truncated cone and is grazed, with only a slight clearance 4, by the blade 5 having an end edge 6. The angle of inclination $\zeta$ (zeta) of the housing wall 3 to the radial plane will herein be called the cone angle. In the housing wall 3 grazed by the blade 5, there is a milled-out recess 10 of wedge-shaped cross section and extending spirally from the inside out in the direction of impeller rotation. The radially inward edge 9 of this recess 10 forms a stationary shearing edge having an angle of inclination $\delta$ (delta).

Figure 4:
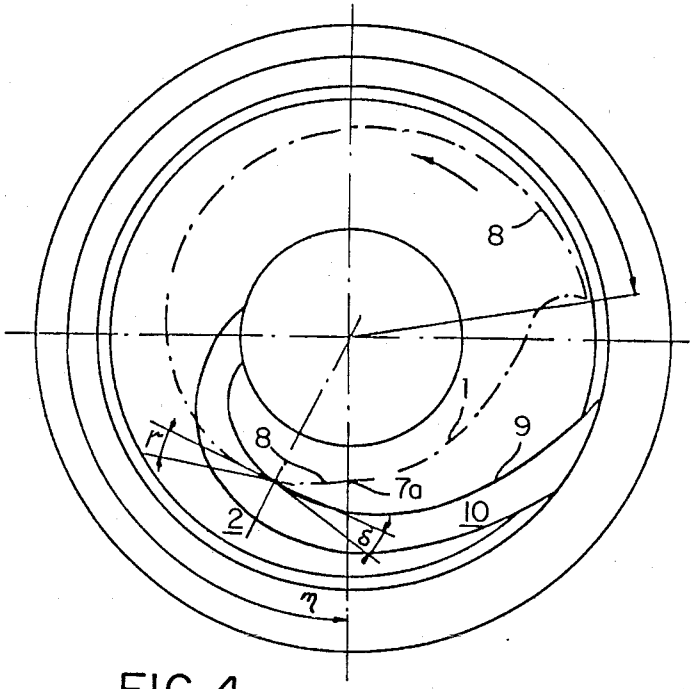
FIG. 4 is a plan view of the truncated-cone housing wall in the direction indicated by arrow A of FIG. 3, with a projection of the leading edge of the impeller.
Figure 3:
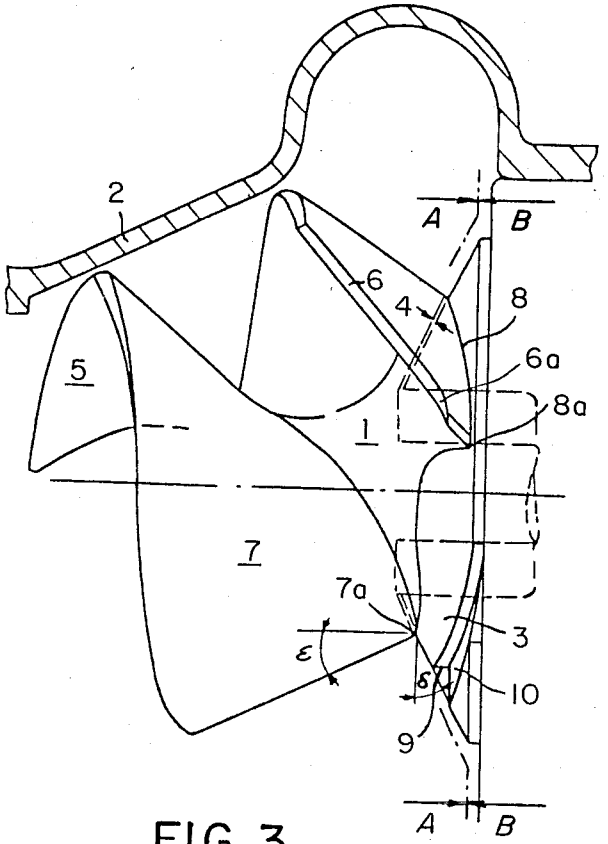
FIG. 3 is a side view of the impeller and the truncated-cone housing wall with the outer housing cut away.
Figure 5:
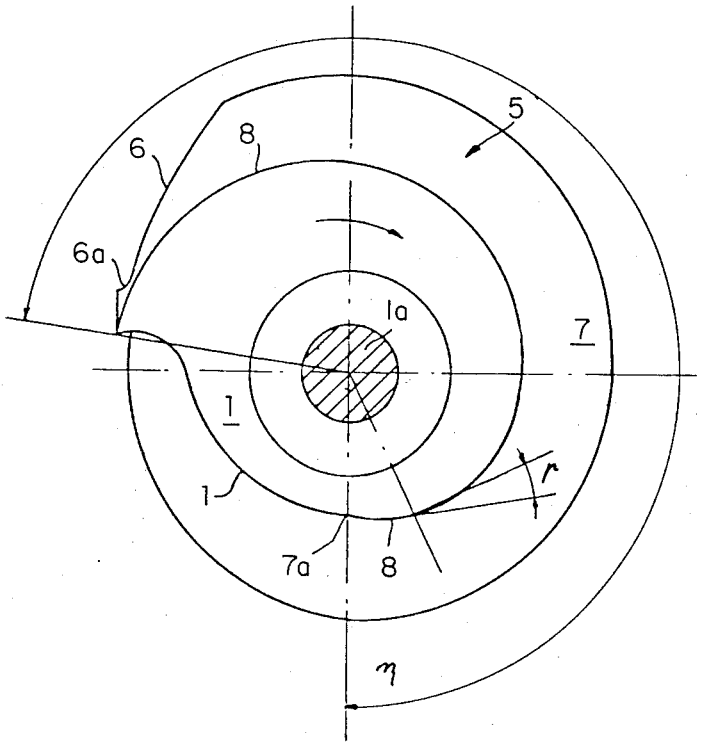
FIG. 5 is an end view of the impeller of the pump of FIGS. 3 and seen in the direction indicated by arrow B in FIG. 3.
Figure 8:
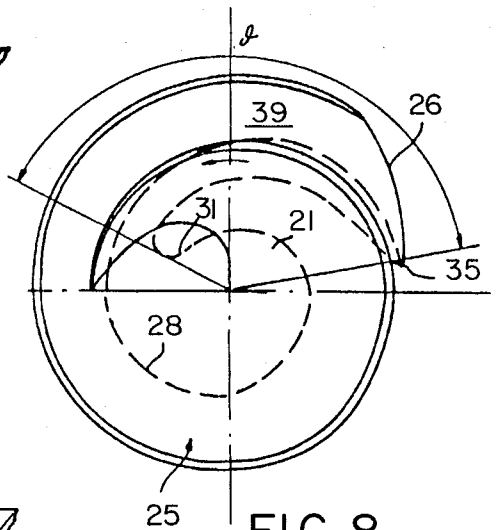
FIG. 8 is a plan view on the impeller of FIG. 6.
Figure 7:
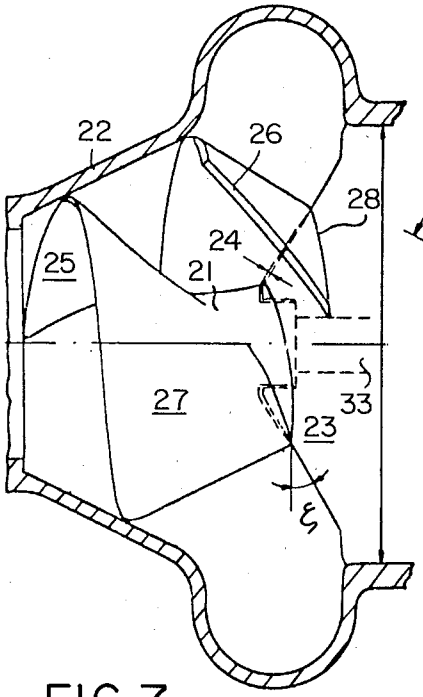
FIG. 7 is a side view of the impeller and the truncated-cone housing wall of the second exemplary embodiment with the outer housing cut away.
Figure 6:
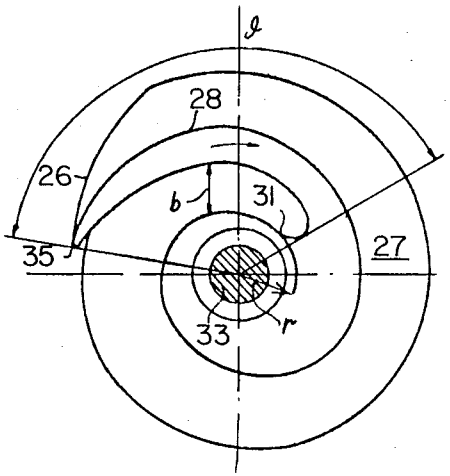
FIG. 6 is an end view of the impeller of a second exemplary embodiment of the invention.
Figure 10:
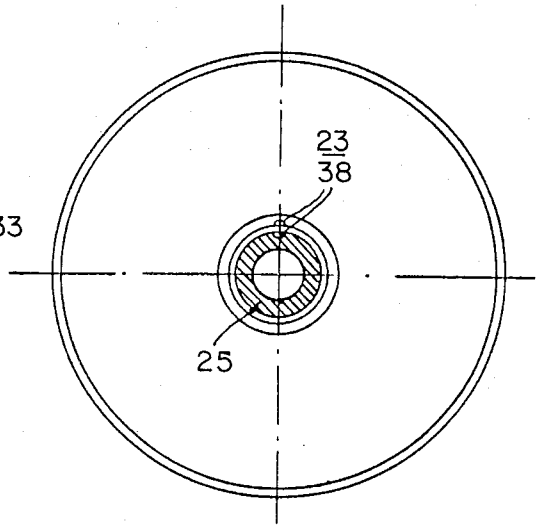
FIG. 10 is a section taken along the line C—C of FIG. 9.
Figure 9:
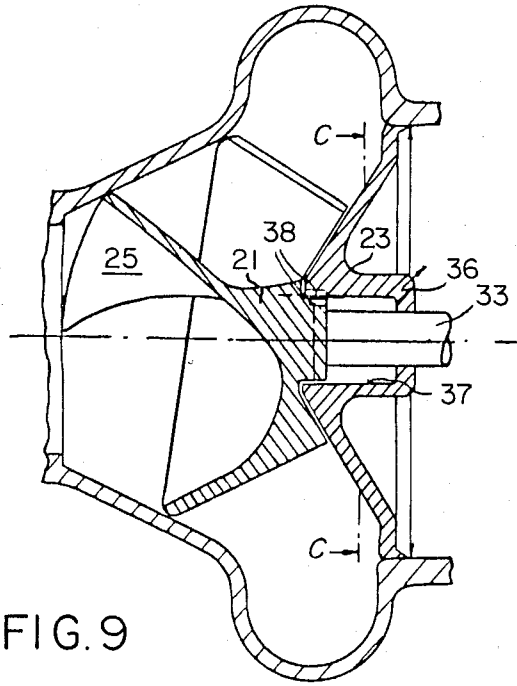
FIG. 9 is an axial section taken through the impeller, truncated-cone housing wall and outer housing of the second exemplary embodiment.

As shown in FIG. 3, the end flank 7 on the delivery side of the blade 5 has a flank angle $\epsilon$ (epsilon). At this angle $\epsilon$, the blade flank 7 merges at the point 7*a* with the leading edge 8 of the blade 5; at this point 7*a*, the leading edge 8 of the blade terminates at the hub 1. As shown in FIGS. 4 and 5, the leading edge 8 of the blade, which forms the limitation of the blade flank 7 on the delivery side and grazes the truncated-cone housing wall 3, extends over a circumferential angle $\eta$ (eta) as far as the blade tip 8*a*, at which the end edge 6 of the blade terminates via a step 6*a*. This leading edge 8 of the blade, which is embodied as a sharp shearing edge and cooperates with the counterpart edge 9 of the housing wall 3, leads at an angle $\gamma$ (gamma) to the hub 1. The condition here is that the two angles $\delta$ and $\gamma$ together must not amount to a value as great as 180°, because only then does a genuine shearing action take place with a simultaneous expulsion of the shredded pieces. In connection with the angles $\epsilon$, $\zeta$ and $\eta$ the following should also be noted: The flank angle $\epsilon$, which causes a looped piece of fibrous material arriving at the flank 7 to slide away toward the delivery side and which must therefore amount to at least 5°, is suitably between approximately 15° and 40°; an angle $\epsilon$ of 30° has proven to be particularly suitable. The case of the cone angle $\zeta$ of the housing wall 3 is similar; that is, values between 15° and 40° are also suitable for this angle, and an angle $\zeta$ of 30° has also proven to be good in actual practice. By contrast, the circumferential angle $\eta$ of the leading edge of the blade (between the tip 8*a* and the point 7*a*) can assume practically any value between approximately 20° and 360°. However, circumferential angles $\eta$ of between 90° and 270° have proven to be particularly advantageous.

Thanks to the embodiment described, a relatively long piece of fibrous material no longer needs to slide away along the end edge 6 of the blade, with its always relatively slight inclination, up to the blade tip 8*a* in order to reach the vicinity of the cooperating shearing edges 8, 9; instead, the piece of fibrous material will slide away directly on the flank 7 on the delivery side, toward the point 7*a* of the least radial distance from the leading edge 8 of the blade, and as it passes over this point 7*a* it will be shredded via the counterpart shearing edge 9 of the housing wall. Even though several passes or revolutions of the impeller may be needed to shred the fibrous material completely, this process still takes place considerably more rapidly than the time it takes for the piece of fibrous material to slip completely off the end edge 6 of the blade. It may even be appropriate to prevent this travel all the way along the end edge 6*a* this may for instance be accomplished by the step 6*a* of this end edge immediately prior to the blade tip 8*a*, as shown in the drawing. As a result, thin pieces of fibrous material, such as loops of textiles, yarns and the like, can be prevented from traveling all the way to behind the impeller, where they could slip into the narrow gap 4 between the leading edge and the housing wall 3 and cause the impeller to jam.

The impeller of the centrifugal pump shown in FIGS. 6–10 has a conical hub 21 with a blade 25, the shaft 33 of which passes through the housing wall 23 on the delivery side, which is embodied as a truncated cone. The housing wall 23, having a cone angle $\zeta$ between 5° and 70°, is grazed by the leading edge 28 of the blade flank 7 on the delivery side, with only a slight clearance 24 between them. This leading edge 28 extends from the blade outlet tip 35, at which the end edge 26 terminates, in a spiral pattern over a relatively long distance up to a point 31, at which it terminates at the hub 21 having a relatively short radius r. As a result, over a relatively wide arc $\theta$ (theta), which is preferably between 30° and 90°, between the blade outlet tip 35 and the hub point 31 mentioned above, a relatively large area of the housing wall 23 is exposed. The exposure of the housing wall by means of a reduction in the impeller hub radius r may be carried only so far as not to impair the strength of the structure needed for transmitting force from the drive shaft 33 to the blade by means of the impeller hub. The width b of the exposed portion of the rearward housing wall which becomes visible between the flank 27 on the delivery side and the flank 39 on the intake side in the impeller pumping conduit decreases, the more it extends toward the inlet portion of the impeller. This decrease in the width b in the direction of the impeller inlet takes place for reasons having to do with the strength and stability of the end portion of the blade. Also for reasons of strength, the exposed portion of the housing wall in the impeller pumping conduit will have an arc $\zeta$ calculated from the tip 35 of the impeller end edge on, of 20° for example, with certain impeller shapes permitting an arc of up to 180°, preferably 30°–90° as indicated above. This means that the leading edge 28 may extend over a circumferential angle $\eta$ of between 360° and 540°.

A discharge opening 36 is provided in the housing wall 23 in the vicinity of the drive shaft to allow gases traveling with the pumped medium to escape; such gases are separated out toward the center of impeller rotation and because of the exposure on the delivery side of the impeller they reach the center of the housing wall.

The impeller hub 21 and the housing wall 23 also form a labyrinth between the exposure on the impeller delivery side and the interior 37 between the hub and the rear wall, where the discharge opening 36 is located, so that any solid pieces carried along in the medium cannot get into the discharge opening.

The labyrinthine structure is also interrupted, at least on the side toward the housing wall (in FIG. 9, on the hub side as well), by means of a transverse groove 38, so as to produce a self-cleaning effect.

It is to be understood that the foregoing text and drawings relate to embodiments of the invention given by way of example but not limitation, various other embodiments and variants being possible within the spirit and scope of the invention.

What is claimed is:

1. A centrifugal pump of the open type with a single-blade impeller, in particular for pumping viscous media, wherein the discharge end of the blade, with clearance, grazes a housing wall through which the shaft of the impeller passes, and the blade flank on the delivery side of the pump terminates prior to the housing wall in a leading edge which extends between the tip of the end edge of the blade and the hub of the impeller, characterized in that the housing wall is a right truncated cone, wherein the leading edge of the impeller blade flank on the delivery side grazing the truncated-cone wall with clearance (4; 24) extends from the blade outlet tip over a relatively long distance of at least 20° up to a point at which it terminates in the impeller hub.

2. A centrifugal pump in accordance with claim 1, wherein the leading edge of the impeller blade flank on the delivery side extends between the outlet tip and the terminal point at the hub over a circumferential angle of at least 360° and a maximum of 540°.

3. A centrifugal pump in accordance with claim 2, wherein the area of the housing wall which is exposed because of the long leading edge between the blade flank on the delivery side and the blade flank on the intake side extends over an arc ($\zeta$) between the impeller edge tip and said hub point of at least 30°.

4. A centrifugal pump in accordance with claim 3, wherein a discharge opening for gases emerging from the medium being pumped is provided in the housing wall in the vicinity of the drive shaft.

5. A centrifugal pump in accordance with claim 4, wherein the impeller hub and the housing wall between the exposed wall area and the interior formed between the hub and the rear wall and ventilated by a discharge opening form a labyrinth, which prevents the egress of solid pieces into the discharge opening.

6. A centrifugal pump in accordance with claim 5, wherein the labyrinth is interrupted at least on the wall side by transverse grooves.

7. A centrifugal pump in accordance with claim 3, wherein the impeller hub and the housing wall between the exposed wall area and the interior formed between the hub and the rear wall and ventilated by a discharge opening form a labyrinth, which prevents the egress of solid pieces into the discharge opening.

8. A centrifugal pump in accordance with claim 2, wherein a discharge opening for gases emerging from the medium being pumped is provided in the housing wall in the vicinity of the drive shaft.

9. A centrifugal pump in accordance with claim 8, wherein the impeller hub and the housing wall between the exposed wall area and the interior formed between the hub and the rear wall and ventilated by a discharge opening form a labyrinth, which prevents the egress of solid pieces into the discharge opening.

10. A centrifugal pump in accordance with claim 2, wherein the impeller hub and the housing wall between the exposed wall area and the interior formed between the hub and the rear wall and ventilated by a discharge opening form a labyrinth, which prevents the egress of solid pieces into the discharge opening.

11. A centrifugal pump in accordance with claim 10, wherein the labyrinth is interrupted at least on the wall side by transverse grooves.

12. A centrifugal pump in accordance with claim 1, wherein a discharge opening for gases emerging from the medium being pumped is provided in the housing wall in the vicinity of the drive shaft.

13. A centrifugal pump in accordance with claim 12, wherein the impeller hub and the housing wall between the exposed wall area and the interior formed between the hub and the rear wall and ventilated by a discharge opening form a labyrinth, which prevents the egress of solid pieces into the discharge opening.

14. A centrifugal pump inaccordance with claim 13, wherein the labyrinth is interrupted at least on the wall side by transverse grooves.

15. A centrifugal pump in accordance with claim 1, wherein the impeller hub and the housing wall between the exposed wall area and the interior formed between the hub and the rear wall and ventilated by a discharge opening form a labyrinth, which prevents the egress of solid pieces into the discharge opening.

16. A centrifugal pump in accordance with claim 15, wherein the labyrinth is interrupted at least on the wall side by transverse grooves.

17. A centrifugal pump in accordance with claim 1, in particular for pumping long-fibered suspended solid materials, wherein the leading edge is embodied as a sharp shearing edge cooperating with a counterpart shearing edge of the housing wall.

18. A centrifugal pump in accordance with claim 17, wherein the angle of inclination ($\epsilon$) of the blade flank on the delivery side and the cone angle ($\zeta$) of the housing wall each amount to between at least 5° and a maximum of 70°, while the circumferential angle ($\eta$) of the blade leading edge between the blade tip and the point closest to the axis on this edge amounts to between 90° and 270°.

19. A centrifugal pump in accordance with claim 18, wherein the sum of the suitably acute angle of inclination ($\gamma$, $\delta$) of the blade leading edge and the counterpart shearing edge differs from 180°.

20. A centrifugal pump in accordance with claim 19, wherein the blade end edge, directly before the blade tip (6*a*) on the delivery side, has a step which makes it impossible for pieces of fibrous material to slide in an unhindered manner along the end edge.

21. A centrifugal pump in accordance with claim 18, wherein the angle of inclination ($\epsilon$) and the cone angle ($\zeta$) each amount to between 15° and 40°.

22. A centrifugal pump in accordance with claim 1, wherein the leading edge of the impeller blade between the outlet tip and the terminal point at the hub extends over a circumferential angle of at least 90°.

* * * * *